US010364060B2

(12) United States Patent
Etem et al.

(10) Patent No.: US 10,364,060 B2
(45) Date of Patent: Jul. 30, 2019

(54) FLAT-FOLDING BOX COVERS

(71) Applicants: Jeanne Helen Etem, Chanhassen, MN (US); Julie Moore Etem, Chanhassen, MN (US); Sherrie Lea Sullivan, Hopkins, MN (US)

(72) Inventors: Jeanne Helen Etem, Chanhassen, MN (US); Julie Moore Etem, Chanhassen, MN (US); Sherrie Lea Sullivan, Hopkins, MN (US)

( * ) Notice: Subject to any disclaimer, the term of this patent is extended or adjusted under 35 U.S.C. 154(b) by 0 days.

(21) Appl. No.: 15/083,326

(22) Filed: Mar. 29, 2016

(65) Prior Publication Data

US 2018/0086496 A1 Mar. 29, 2018

(51) Int. Cl.
*B65D 5/42* (2006.01)
*B65D 5/62* (2006.01)

(52) U.S. Cl.
CPC ..... *B65D 5/425* (2013.01); *B65D 5/4287* (2013.01); *B65D 5/62* (2013.01); *B65D 2313/04* (2013.01)

(58) Field of Classification Search
CPC ..... B65D 2313/04; B65D 5/425; B65D 5/62; A47K 10/421
USPC ..... 229/125.05, 125.15; 221/305; 206/233, 206/395
See application file for complete search history.

(56) References Cited

U.S. PATENT DOCUMENTS 5,140,562 A 8/1992 Crispi
5,497,876 A 3/1996 Fleming
5,639,523 A 6/1997 Ellis
D390,391 S 2/1998 Hau
D494,859 S 8/2004 Keberlein
6,884,081 B1 4/2005 Ovadia
D514,928 S 2/2006 Keberlein
7,665,628 B1 2/2010 Milligan
7,737,391 B2 6/2010 Long
8,602,258 B2 * 12/2013 Long ..... B65D 83/0894 221/305
2002/0067038 A1 6/2002 Tran
2003/0205613 A1 11/2003 Schliebner
2006/0049067 A1 3/2006 McDonald
2007/0063007 A1 * 3/2007 Campbell ..... B65D 5/445 229/125.21
2009/0212096 A1 8/2009 Sieber
2012/0283084 A1 * 11/2012 Cheich ..... A47K 10/421 493/464
2013/0097834 A1 4/2013 Pacione

* cited by examiner

*Primary Examiner* — Christopher R Demeree
(74) *Attorney, Agent, or Firm* — Haugen Law Firm PLLP

(57) ABSTRACT

A flat-folding box cover with magnets near one edge of the side panels that align with magnets of the opposite polarity on flaps of the adjacent side panel to hold the box cover into position is provided. The flat-folding box cover includes a top panel with aperture and four side panels that when assembled fits over the top of a tissue or other box. Advantageously, the box cover may be kept in the flat state or folded into a box shape as needed.

The box covers may be sold finished from a seller. In another case, consumers may select from a set of options provided by a seller for the box cover design. In another case, the consumer may supply the seller with custom artifacts such as photos or artwork which the seller would incorporate into the finished box cover. Kits may also be sold allowing the purchaser to customize the box cover themselves.

20 Claims, 8 Drawing Sheets

FLAT-FOLDING BOX COVERS

This patent claims the benefit of Provisional Patent 62/088,657, filed on 2014 Dec. 7 with a file extension filed on 2015 Dec. 7. Provisional Patent filed by Eduardo E. Drake, Registration #40594.

COPYRIGHT NOTICE AND PERMISSION

A portion of this patent document contains material subject to copyright protection from the inventors original provisional patent, 62/088,657, which was had a copyright claimed in 2014 with the copyright holders consisting of Jeanne H. Etem, Julie M. Etem and Sherrie Lea Sullivan.

BACKGROUND - PRIOR ART
U.S. Patents

| Patent number | Kind Code | Issue Date | Patentee |
|---|---|---|---|
| U.S. Pat. No. 5,140,562 | A | 1992 Aug. 13 | James Crispi |
| U.S. Pat. No. 5,497,876 | A | 1996 Mar. 12 | Barbara Fleming |
| U.S. Pat. No. 5,639,523 | A | 1997 Jun. 17 | Diana Ellis |
| U.S. Pat. No. 6,884,081 | B1 | 2005 Apr. 26 | Joseph Ovadia |
| U.S. Pat. No. 7,665,628 | B1 | 2010 Feb. 23 | Loren Milligan |
| U.S. Pat. No. 7,737,391 | B2 | 2010 Jun. 15 | Leslie Thomas Long |
| US D390391 | S1 | 1998 Feb. 10 | Junior Julian Hau |
| US D494859 | S1 | 2004 Aug. 24 | Gerald J. Keberlein |
| US D514928 | S1 | 2006 Feb. 14 | Gerald J. Keberlein |

U.S. Patent Applications

| Publication number | Kind Code | Publication Date | Applicant |
|---|---|---|---|
| 20020067038 | A1 | 2002 Jun. 6 | Lam Tran |
| 20030205613 | A1 | 2003 Nov. 6 | Angela Schliebner |
| 20060049067 | A1 | 2006 Mar. 9 | Duane McDonald |
| 20090212096 | A1 | 2009 Aug. 27 | Helmut Sieber |
| 20130097834 | A1 | 2013 Apr. 25 | John Anthony Pacione |

FIELD OF THE INVENTION

The present invention relates generally to flat-folding box covers, with specific emphasis on tissue box covers.

BACKGROUND OF THE INVENTION FIELD

Decorative boxes, specifically tissue boxes, typically are created by adding designs on the cardstock tissue box at the tissue box, or cardstock manufacturer. A second approach to offering decorative tissue boxes are rigid tissue box covers as evidenced in design patents, D390391, D494859, and D514928. The tissue boxes with a decorative design have graphics but they don't have the sheen of laminated paper, nor the flexibility to customize the box look. Another issue is that the tissue boxes need to be glued, limiting their use to one-time. If the tissue boxes could be folded and reconfigured without adhesive, but rather had flaps and slots for assembly, they could be reused a limited number of times before the box configuration lost its crispness and consequently its decorative appeal. In an effort to give a more decorative permanent look numerous rigid box covers with more upscale designer looks have come onto the market. They are placed over the tissue box with versions available for both the square and rectangular tissue boxes. These rigid boxes for the most part cannot be customized, and their bulk also makes them expensive to ship. The present inventors saw three specific issues they wanted to address, one the need for a decorative, reusable box cover that could ship flat, two the need for a decorative reusable box cover that would not have its appearance degrade when it was taken apart and then reassembled and would therefore have a long life, and three a product design that would allow users to customize their box with their own designs.

DESCRIPTION OF PRIOR ART

Prior art descriptions are listed below.

1. Tissue boxes that have a waste receptacle built into the box. U.S. Pat. No. 5,145,062. This patent is based on a standard tissue box and doesn't have a decorative element, nor does it disclose a box that doesn't require adhesive or a box that can be folded together and then unfolded for later reuse.
2. 20130097834 claims a tissue box that is designed for production, with the emphasis on how they can be filled with tissues from the top or bottom.
3. Patents that detail a layout on a one piece blank for a box to simplify graphic production, US20060049067A1 or a graphic design on a one piece blank that can be folded into a box, U.S. Pat. No. 5,497,876. U.S. Pat. No. 5,497,876 is probably the closest invention to the invention claimed in this application. The difference is that the box is folded together with one piece of the cutout going into a slot or other holding mechanism in another part resulting in the lessening of the crisp box look and the loss of rigidity each time the box is constructed. The product is designed for one-time use as a gift box.
4. Tissue box covers that retain a three dimensional shape and do not go flat; they are rigid boxes. U.S. Pat. No. 7,665,628 and U.S. D390391.
5. US D514928 claims a tissue box cover from a one piece paper cutout that folds together. This patent claims a different one piece paper layout than the product claimed in this application, and is not designed for multiple reuses.
6. US D494859 claims a triangular tissue box, and not a tissue box cover.
7. 20020067038 claims a tissue box cover that has inserts for photos or other decorative elements. The box has a rigid three-dimensional shape and does not go flat when not in use.
8. 20030205613 claims a tissue box with a laminated piece that covers the tissue box orifice so that tissue does not get damaged. The application also discloses a flat sheet layout for production that folds into a tissue box. This flat layout is not the same as the product claimed in the current application.
9. 20090212096 claims a foldable box, made out of a flat sheet cutout, folding without the use of adhesives. The 20090212096 application relies on a decorative tab that is inserted into a cutout in the cardstock that holds the box together. The product claimed in this application does not have parts that fold into each other but instead uses magnets or other fasteners to hold the box cover together.

Other Pertinent Patents.

10. U.S. Pat. No. 5,639,523 relates to the use of transparent plastic material with adhesive for decorative envelopes and potentially for decorative boxes. The difference in this claim and the invention disclosed in this application is that the transparent plastic material in U.S. Pat. No. 5,639,523 is only for decorative purposes, the invention claimed in this application uses the laminating process to create a strong durable box cover that can be used, then folded flat and then used again multiple times. The main claim of this patent is for a flat-folding box cover. Laminate, or a box cover without coverings, are all options of the flat-folding box cover's final construction.

11. U.S. Pat. No. 6,884,081 relates to the use of magnets on a jewelry box to hold the cover down, and not the use of magnets to hold the box together as the product claimed here does. This was the only patent discovered that used magnets in a decorative box.

The prior art does not address the combination of all of the following points that led to the development of the product claimed in the current application.

a. The need for a box cover that can go completely flat for ease of storage and economy of shipment.
b. A box cover that could be used multiple times and would resist losing its "new box" look with multiple uses that a foldable box (with tabs and cutout slots) undergoes.
c. A box cover that could be modified to display images furnished by the eventual retail purchaser to create their own custom box cover.

SUMMARY OF THE INVENTION

Folding Box Covers

The flat-folding box cover of this invention has several features, with no one single feature alone responsible for the invention's desirable attributes. Without limiting the scope of the invention that will be described in the claims, prominent features will be discussed. The preferred embodiment of the flat-folding box cover consists of a top panel with an aperture and four side panels, all made of decorative or plain cardstock. The cardstock is laminated for a shiny, protective finish. The top panel and all four side panels are supported with stiffening pieces. One side of each side panel has magnets embedded into the stiffening pieces. Each side panel has two side flaps, one flap folds over the magnets of one polarity embedded in the stiffening pieces. The other flap has magnets of the opposite polarity positioned so that, on assembly, the magnets align with the magnets of one polarity embedded into the stiffening pieces.

Tab liners are positioned over the magnets of opposite polarity on the side flaps. An end flap folds over the bottom of each side panel for a better decorative effect. In some embodiments, the inner surfaces may be covered by a lining material. When assembled, the flaps with magnets of the opposite polarity reside against the adjacent side panel with magnets of one polarity to form a magnetic bond that holds the box cover in place. The cardstock cutout piece is produced in one piece and is able to lie flat and can be formed into a box shape. The interfaces between the top panel and four side panels are scored or creased to facilitate folding. In the preferred embodiment of the folding box cover, the aperture will have a decorative ring around its edge. The box cover can be configured to cover all standard tissue box sizes and configured to go into other box shapes. Box covers can be configured to fit over dispensers for paper hand towels, moist hand wipes, cosmetic wipes, baby wipes etc.

In additional embodiments, the flat-folding box cover with a top panel and four side panels may be made of paper, cardboard, foam board, plastic and other materials.

In additional embodiments, the decorative designs might be furnished by the end user either to the manufacturer or the selling entity for use as decoration for either or both top panels and side panels.

In additional embodiments, the end user may select to customize some aspects of the configuration by choosing from a set of design options provided by a seller.

In additional embodiments, the laminate might have slots where photos or other items could be inserted by the eventual purchaser.

In some embodiments, the flat-folding box cover might be embellished with various materials such as beads, trim, borders, stickers and other decorative materials.

In some embodiments, the plastic transparent laminate material is not used.

In some embodiments, a coating might be applied to the decorative pattern to add decorative appeal, or water resistance or strength to the cardstock, or all three.

In some embodiments, the flat-folding box cover fasteners may be snaps, hook and loop, or other fastening devices. The number, size and placement of the fasteners may vary.

In some embodiments, the aperture on the top of the flat-folding box cover will not have a decorative ring.

In some embodiments, the cardstock cutout may have different layouts to create the flat-folding box cover.

In some additional embodiments, the flat-folding box cover will be produced in a kit format. Some of the potential kit embodiments are listed below.

a. The kit may be an undecorated flat-folding box cover. The consumer would supply the embellishments.
b. The kit may be a partial set of components. The consumer may need to purchase additional items in order to complete a flat-folding box cover.
c. The kit may be all inclusive with everything needed to make a flat-folding box cover and may include, but is not limited to: decorative layers, lining layers, coating/protective layers, panels, stiffeners, fasteners, decorative ring, adhesives, and embellishments. The kit may contain the actual components or the patterns from which components may be created.
d. The kit may include software to create embellishments.
e. The kit may specify links to websites where embellishments may be created, purchased or downloaded.

The method or steps for constructing a finished box cover from the flat-folding cardstock cutout are comprised of:

a. the flat-folding box cover is positioned with the decorative surface down;
b. stiffening pieces are attached to each of the side panels;
c. magnets of one polarity are placed in the stiffening pieces attached to the side panels;
d. magnets of the opposite polarity are placed on the side flaps on the other side of the side panels from the magnets of one polarity;
e. the flaps holding magnets on the side panels are turned 90 degrees away from the decorative side of the flat-folding box cover;
f. the side panels of the cardstock cutout are folded away from the top panel into a box shape;
g. the magnets of opposite polarity on the side flaps are aligned with the magnets of one polarity on the side panels to create a finished box cover.

ADVANTAGES OF THE INVENTION

The six most prominent advantages of the invention are:

1. the use of laminated decorative cardstock or other lightweight material mimics the look of expensive rigid box covers;
2. the flat-folding box cover may be kept flat or folded into a box cover multiple times without any loss of visual appeal;
3. the stiffening pieces help keep the side panels from curling or deforming with repeated use;
4. the flat-folding box cover folds flat, which offers less expensive shipping and more convenient storage options;
5. the invention lends itself to hobby & craft kits;
6. the invention lends itself to customization including the following two examples:
   a. in one example, the consumer selects a configuration from a set of options provided by the seller such as the size of the box cover, the decoration on the top and side panels and the style of the decorative ring;
   b. in the other example, the consumer would supply the design artifacts (photos, artwork etc.) to the seller who would use them as the decoration for the box cover. The consumer could also select from a set of options such as the size of the box cover and the style of the decorative ring.

DRAWINGS—FIGURES

DRAWINGS—REFERENCE NUMBERS

Figure 1:
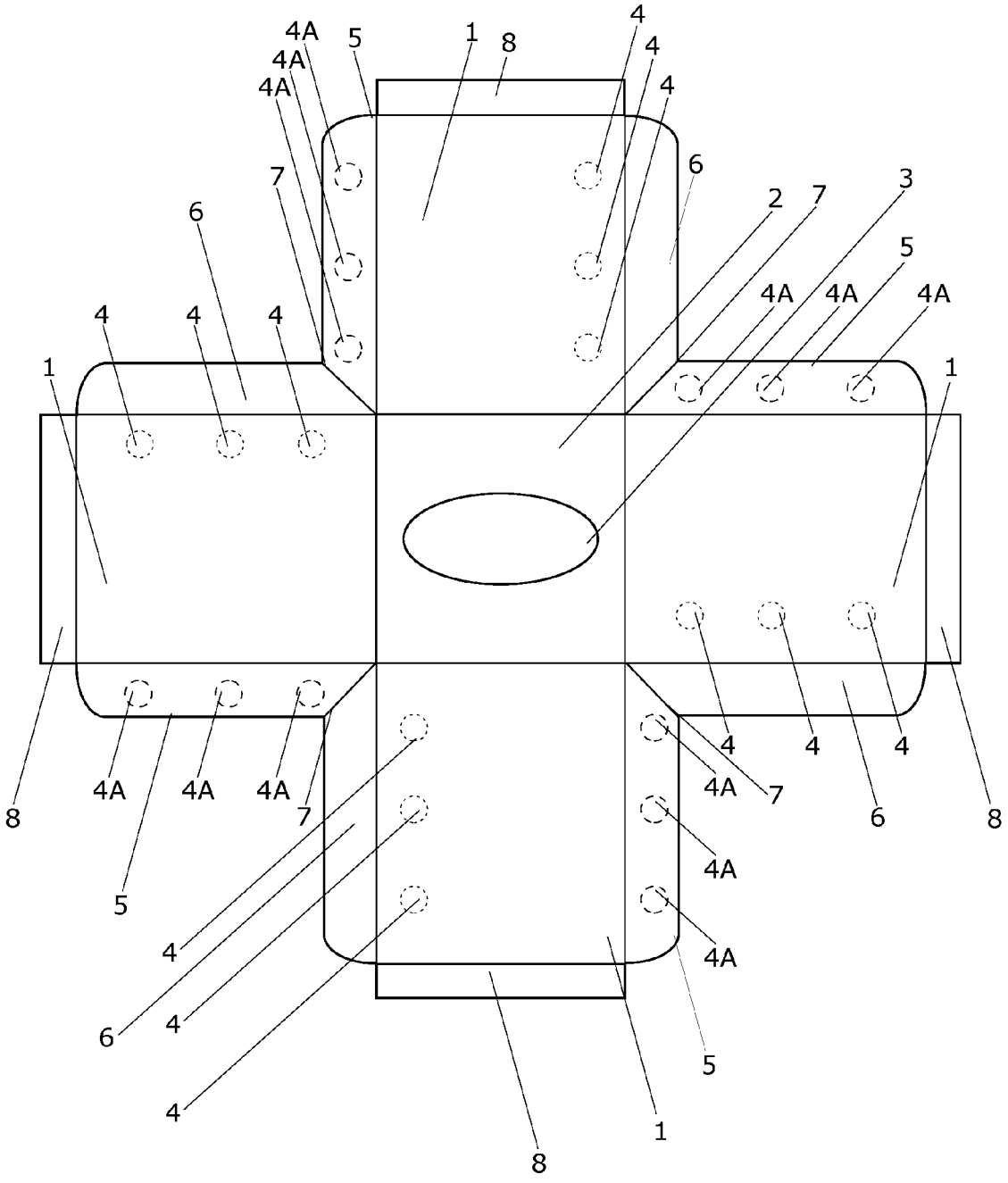
FIG. 1 is a view of the decorative side of the cardstock cutout with magnets of one polarity on the side panels and magnets of opposite polarity on flaps.

1. Side panel with decoration
1A. Stiffening pieces for side panels
2. Top panel
2A. Stiffening piece for top panel
3. Aperture
3A. Aperture Ring
4. Magnets of one polarity on one edge of side panels
4A. Magnets of opposite polarity
5. Side flaps with magnets of the opposite polarity
5A. Tab liners
6. Side flaps without magnets
7. Cutline between flaps
8. End flaps

DETAILED DESCRIPTION OF THE INVENTION

FIG. 1 views the basic cardstock cutout from the decorative side with magnets of one polarity on the side panels and magnets of the opposite polarity on the appropriate flaps which is the basic starting point for many of the embodiments. Four side panels 1 with magnets of one polarity 4 and a top panel 2 with aperture 3, side flaps without magnets 6 and side flaps 5 with magnets of the opposite polarity 4A. FIG. 1 also has end flaps 8 which fold over the bottom ends of the side panels for a completed look. (Shown in FIG. 3) The cutline 7 separates the flaps of the side panels.

Figure 2:
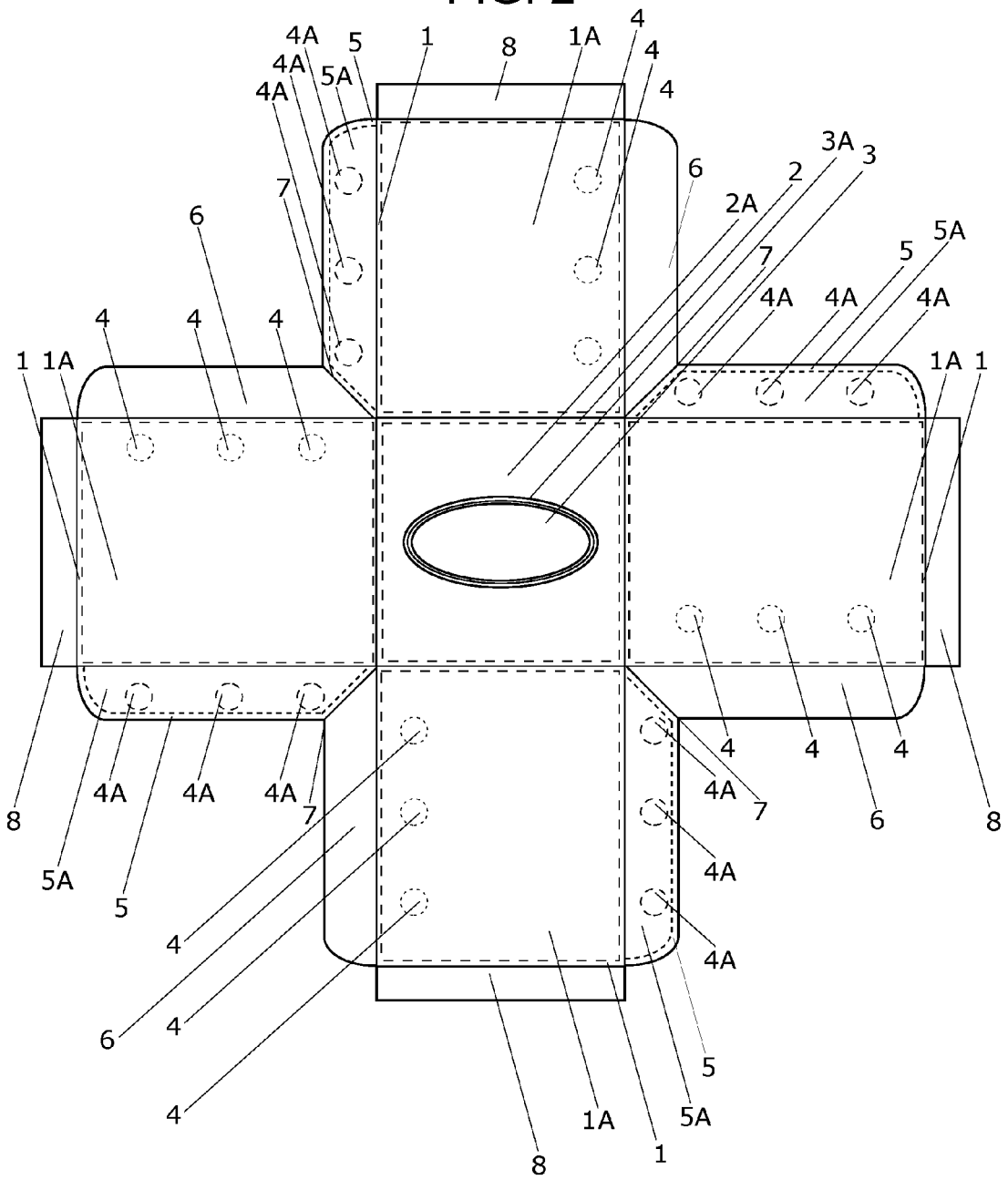
FIG. 2 is a view of the decorative side of the cardstock adding stiffening pieces, magnets of one polarity in the stiffening pieces and tab liners over the flaps with magnets of opposite polarity.

The preferred embodiment of the invention is shown in FIG. 2 from the view of the decorative surface of the cover prior to being assembled into a box cover. The top panel 2 has a stiffening piece 2A, an aperture 3 and an aperture ring 3A. The four side panels 1 have stiffening pieces 1A, have magnets of one polarity 4 embedded near one edge of the stiffening pieces. Side flaps 5 with magnets of the opposite polarity 4A are arranged at a 90 degree angle to the side panels where magnets of one polarity 4 are near the edge of the stiffening pieces. Tab liners 5A are placed over the flaps with magnets of the opposite polarity.

Figure 3:
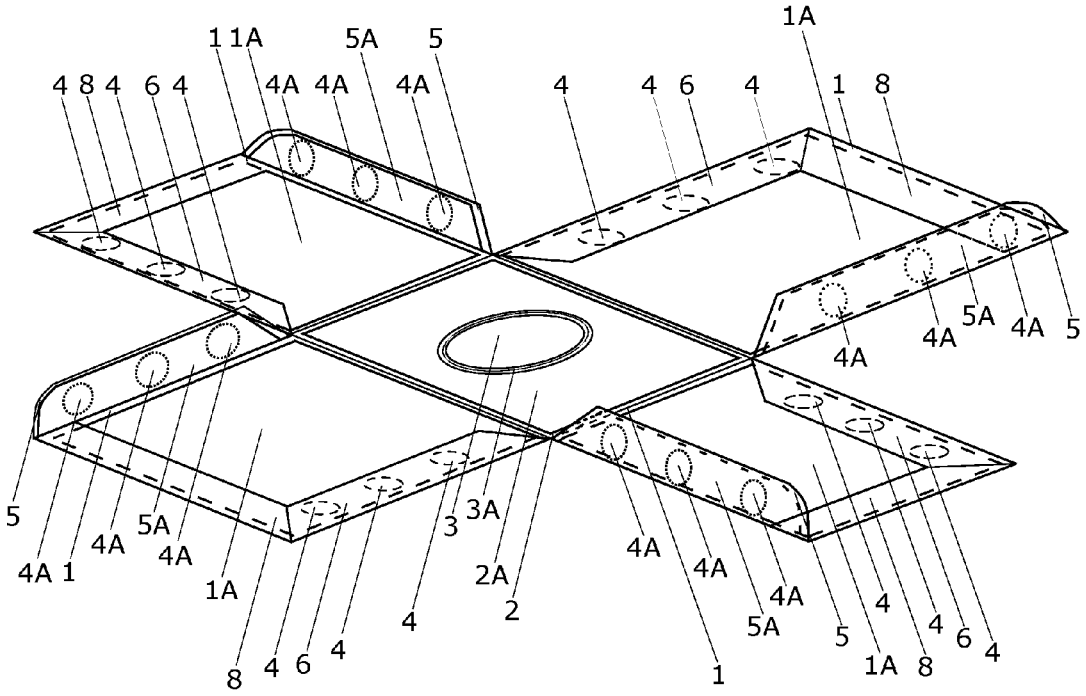
FIG. 3 is a view of the non-decorative side of the cardstock cutout with flaps folded over.

FIG. 3 shows the interior of the flat-folding box cover in the flat position. The end flap 8 has been folded over the end of each side stiffening piece 1A. Side flaps without magnets 6 have been folded over the magnets of one polarity 4 near the edge of the side stiffening pieces. The side flaps 5 with magnets of the opposite polarity 4A are turned at a right angle to the side panel. Tab liners 5A are placed over the side flaps 5 with magnets of the opposite polarity 4A.

Figure 4:
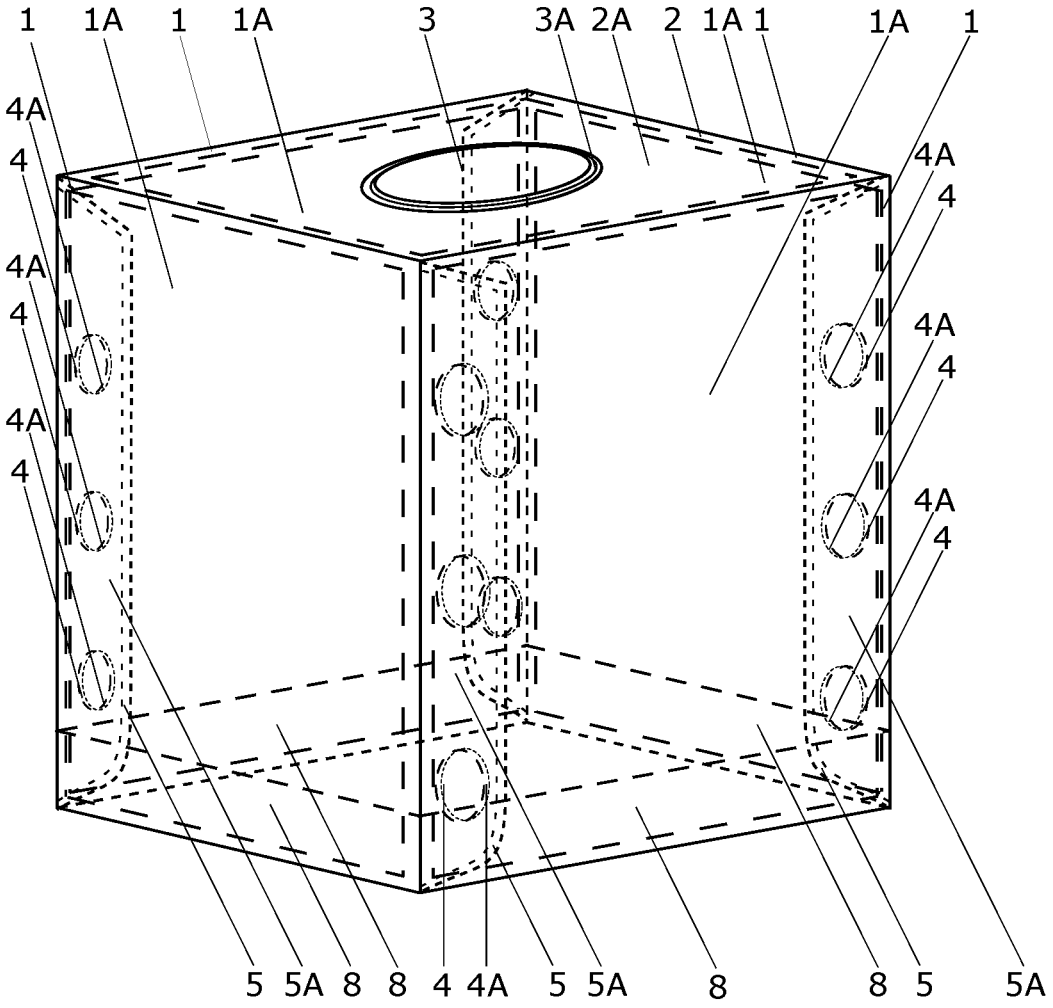
FIG. 4 is a view of the cardstock cutout folded into a box shape.

FIG. 4 shows the flat-folded box cover as assembled. Magnets with one polarity 4 and magnets with the opposite polarity 4A overlap and are shown with two sets of dashes, small dashes for magnets of one polarity 4, that are near the edge of the stiffening pieces 1A and longer dashes for magnets of the opposite polarity 4A that are on the flaps with magnets 5. When the box cover is assembled the two sets of magnets align and hold the box cover together.

Figure 5:
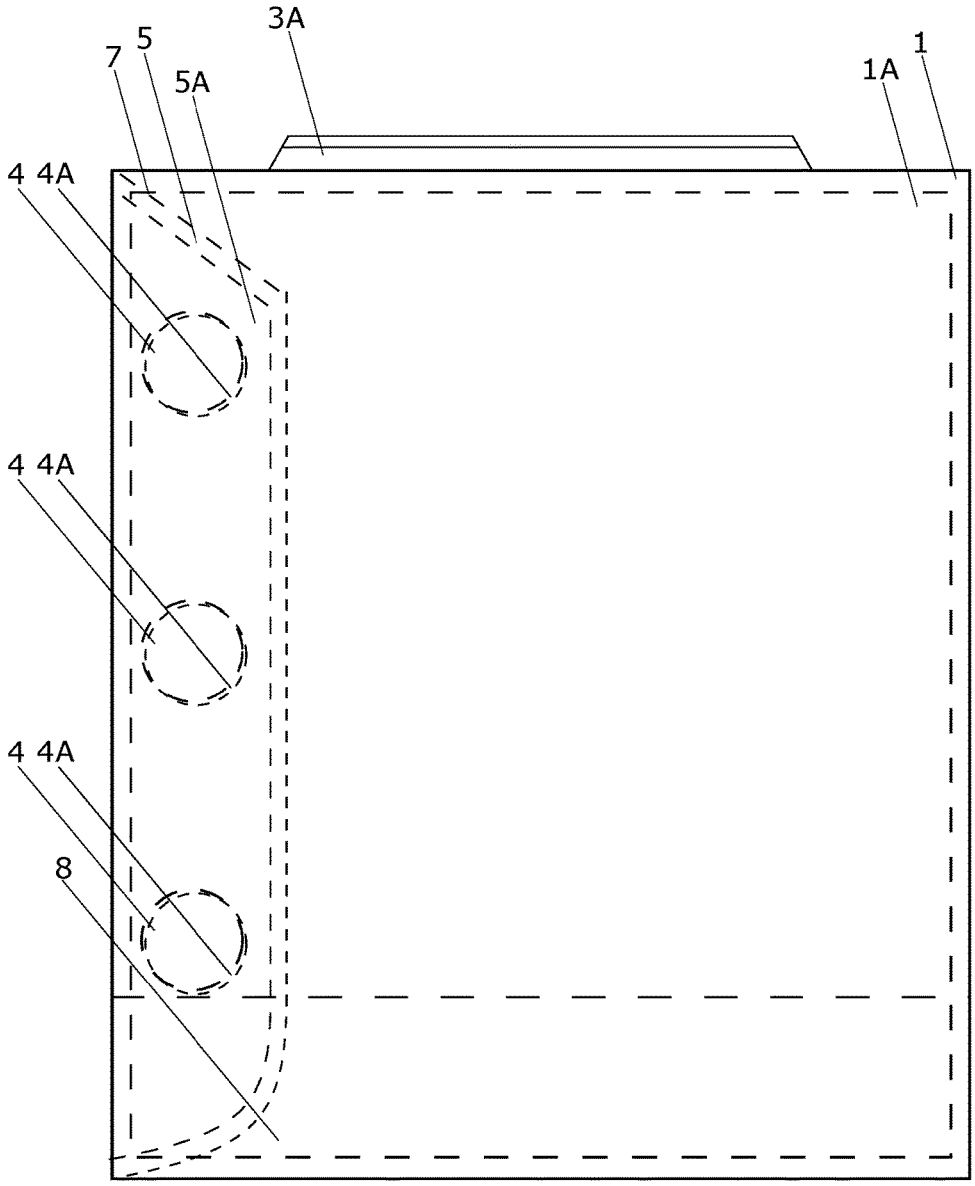
FIG. 5 is a side view of how the magnets align when folded into a box shape.

FIG. 5 shows how magnets of one polarity 4 near the edge of the side panels 1 align with the magnets of opposite polarity 4A on the side flaps with magnets 5 when the box cover is assembled.

Figure 6:
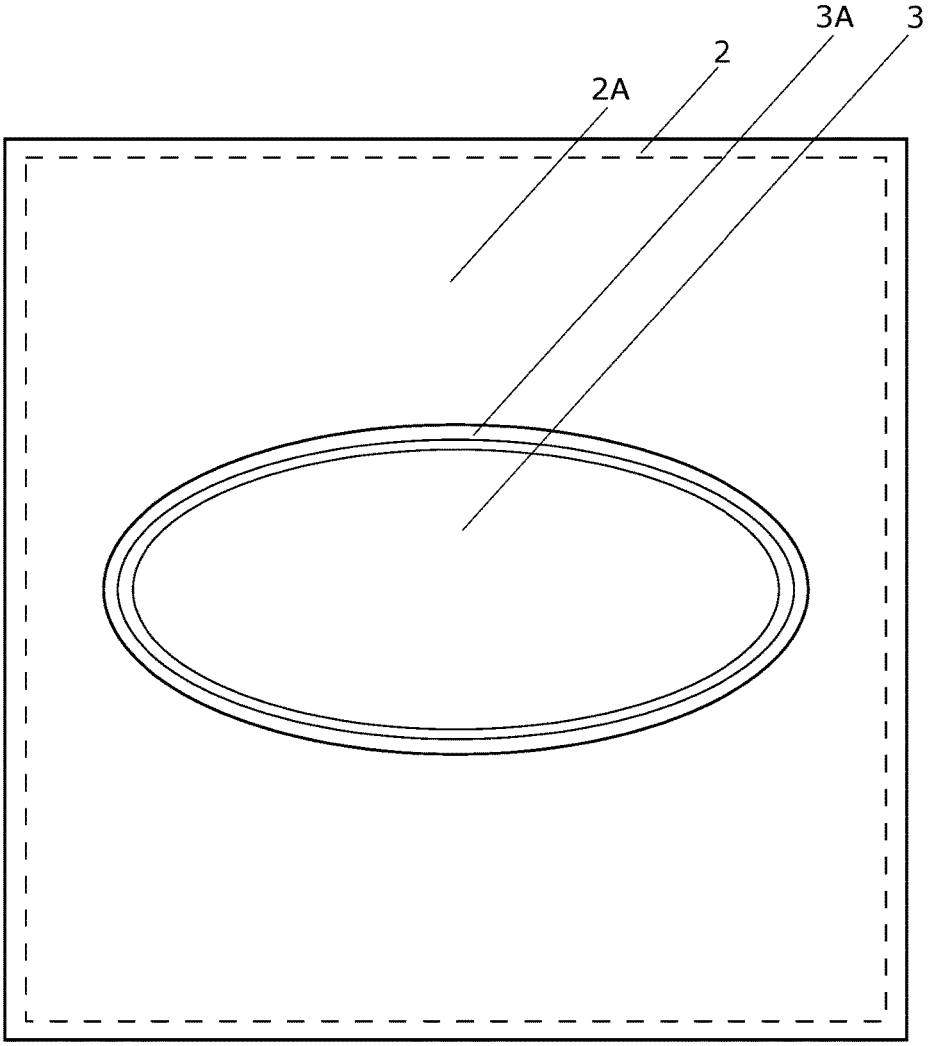
FIG. 6 is a top view of the box cover with its decorative ring.

FIG. 6 shows the top panel 2, stiffening piece for top panel 2A with the aperture 3 and aperture ring 3A.

Figure 7:
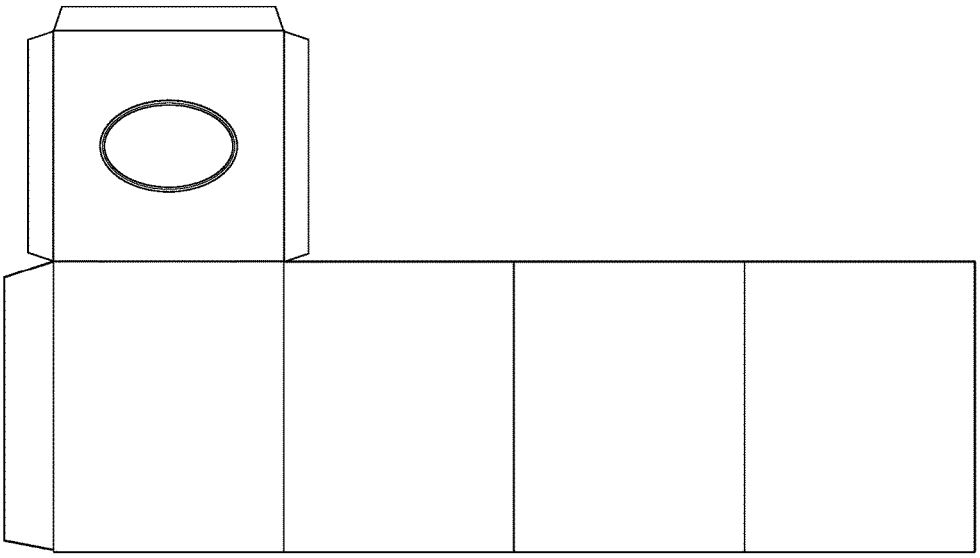
FIG. 7 is a view of a different embodiment cardstock cutout.

FIG. 7 shows an alternative embodiment of the cardstock cutout for the flat-folding box cover which can also be assembled into a box cover.

Figure 8:
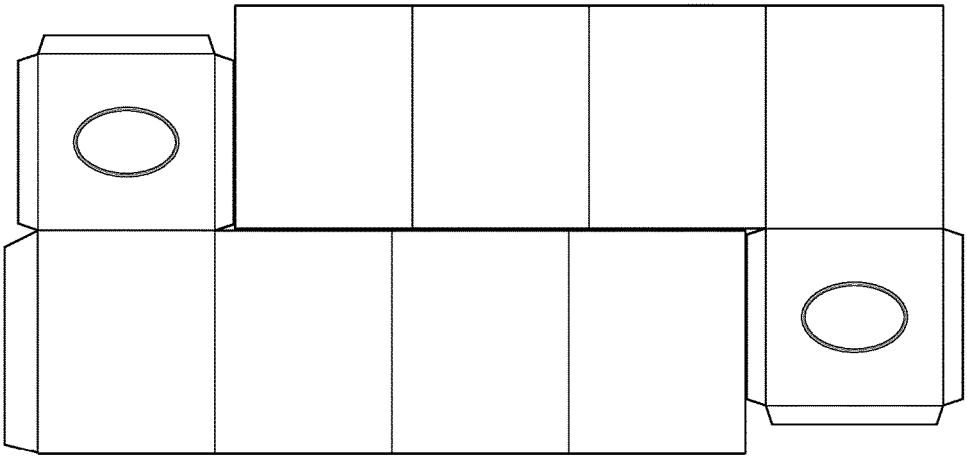
FIG. 8 is a view of combining two pieces of the embodiment of FIG. 7 for production efficiencies.

FIG. 8 shows how two of the embodiments in FIG. 7 could be produced in order to cut waste.

Figure 9:
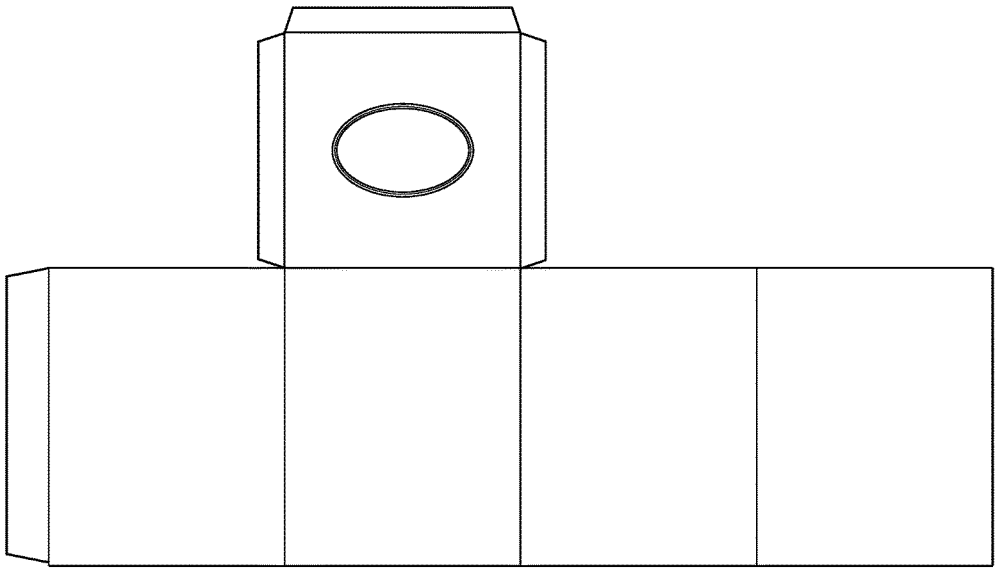
FIG. 9 is a view of another embodiment of the cardstock cutout.

FIG. 9 shows a third embodiment of the cardstock cutout for the flat-folding box cover.

We claim:

1. A flat-folding box cover for primary containers of tissues and other sheet materials comprising:

a) a cutout having a cross shape with a top panel and four side panels wherein the top panel and each side panel has an interior surface and an exterior surface;
b) an aperture in the top panel;
c) a flap extending from one side edge of each side panel with no two flaps adjacent to one another;
d) one or more magnets of one polarity secured on each side panel near the side edge without a flap; and e) one or more magnets of opposite polarity secured to each flap;

whereby, when the side panels are folded at ninety degrees to the top panel, and the flaps are folded at ninety degrees to the side panels, the magnets on the flaps align and engage with the magnets in the side panels to form an assembled box cover that can, if desired, be unfolded to a flat state.

2. The device of claim 1 wherein the cutout is cardstock, leather, fabric, plastic or other material.

3. The device of claim 1 wherein the cutout is laminated.

4. The device of claim 1 wherein the cutout is coated.

5. The device of claim 1 wherein the cutout is scored or creased to facilitate folding.

6. The device of claim 1 wherein the cutout has holes, notches, indentations or other adaptation to accommodate attachment of the magnets.

7. The device of claim 1 wherein the cutout has one or more decorative elements including, but not limited to: fabric, wood, cardstock, paper, leather, metal, plastic, buttons, trim, moldings, ribbons, stickers, paint, beads, photos, words, images, graphics, logos, printing, stencils or other decorative elements.

8. The device of claim 1 wherein a fastener other than the magnets is used, such as one or more: ribbons, strings, hook and loop material, snaps, tabs, slots, buttons, magnetic strips, magnetic tape, static bond, adhesive or other fastener.

9. The device of claim 1 wherein some side panels have one or more magnets secured near one or more of the side edges.

10. The device of claim 1 wherein an ornamental ring is secured around the aperture in the top panel.

11. The device of claim 1 wherein a lining of paper or other material, is affixed to one or more of the interior surfaces.

12. The device of claim 1 wherein a stiffening piece of cardstock, foamboard or other material, approximately the same size and shape as the top panel, is secured to the interior surface of the top panel.

13. The device of claim 1 wherein a stiffening piece of cardstock, foamboard or other material, approximately the same size and shape as each side panel, is secured to the interior surface of one or more of the side panels.

14. The device of claim 13 wherein the stiffening pieces have holes, notches, indentations or other adaptation to accommodate attachment of the magnets.

15. The device of claim 13 wherein one or more magnets are attached near one or more side edges of the stiffening pieces rather than the side panels.

16. The device of claim 1 wherein the cutout has a flap extending from one or more edges of one or more of the side panels.

17. The device of claim 16 wherein some flaps may be folded over and secured.

18. The device of claim 16 wherein one or more magnets are secured to some flaps.

19. The device of claim 1 wherein a kit is supplied comprising the flat-folding box cover and various decorative elements.

20. The device of claim 1 wherein the cutout is not cross-shaped but is another configuration layout.

* * * * *